US010782040B2

(12) United States Patent
Wacker

(10) Patent No.: US 10,782,040 B2
(45) Date of Patent: Sep. 22, 2020

(54) HEAT PUMP SYSTEM WITH FAULT DETECTION

(71) Applicant: Honeywell International Inc., Morris Plains, NJ (US)

(72) Inventor: Paul Wacker, Plymouth, MN (US)

(73) Assignee: Honeywell International Inc., Morris Plains, NJ (US)

( * ) Notice: Subject to any disclaimer, the term of this patent is extended or adjusted under 35 U.S.C. 154(b) by 69 days.

(21) Appl. No.: 16/228,148

(22) Filed: Dec. 20, 2018

(65) Prior Publication Data

US 2020/0200417 A1 Jun. 25, 2020

(51) Int. Cl.

| | |
|---|---|
| ***F24F 11/00*** | (2018.01) |
| ***F24F 11/32*** | (2018.01) |
| ***F24F 11/58*** | (2018.01) |
| *F24F 140/20* | (2018.01) |
| *F24F 110/12* | (2018.01) |
| *F25B 13/00* | (2006.01) |

(52) U.S. Cl.

CPC ..... *F24F 11/32* (2018.01); *F24F 11/58* (2018.01); *F24F 2110/12* (2018.01); *F24F 2140/20* (2018.01); *F25B 13/00* (2013.01); *F25B 2700/2106* (2013.01); *F25B 2700/21152* (2013.01)

(58) Field of Classification Search

CPC ..... F24F 11/32; F24F 11/58; F24F 2110/12; F24F 2140/20; F25B 2700/2106; F25B 2700/21152

See application file for complete search history.

(56) References Cited

U.S. PATENT DOCUMENTS

| | | | | |
|---|---|---|---|---|
| 4,211,089 | A | 7/1980 | Mueller et al. | |
| 4,301,660 | A | 11/1981 | Mueller et al. | |
| 6,086,828 | A * | 7/2000 | Thompson | B01D 53/74 422/173 |
| 6,223,544 | B1 | 5/2001 | Seem | |
| 6,470,735 | B1 * | 10/2002 | Bell | F01M 11/10 184/6.4 |
| 9,024,765 | B2 * | 5/2015 | Hoesl | F24F 11/30 340/588 |
| 2008/0315000 | A1 | 12/2008 | Gorthala et al. | |

(Continued)

FOREIGN PATENT DOCUMENTS

WO 2012164690 A1 12/2012

*Primary Examiner* — Jonathan Bradford

(74) *Attorney, Agent, or Firm* — Seager, Tufte & Wickhem, LLP

(57) ABSTRACT

A system for transferring heat via a refrigerant between an indoor heat exchange coil and an outdoor heat exchange coil of an HVAC system of a building includes an expansion valve and a compressor. The system includes a compressor discharge refrigerant temperature sensor, an outdoor air temperature source, a controller operatively coupled to the compressor discharge refrigerant temperature sensor and the outdoor air temperature source. The controller identifies a difference between the temperatures indicative of the temperature of the compressed refrigerant at or near the output of the compressor and the measure of outdoor air temperature source, identifies a change in the identified difference over time, and reports a fault when the change in the difference exceeds a threshold.

20 Claims, 6 Drawing Sheets

(56) References Cited

U.S. PATENT DOCUMENTS

| | | | | |
|---|---|---|---|---|
| 2009/0020282 | A1* | 1/2009 | Benonysson | F24D 17/0005 165/294 |
| 2012/0054124 | A1* | 3/2012 | Rodrigues | G06Q 50/06 705/412 |
| 2017/0234561 | A1* | 8/2017 | Lin | F25B 1/10 702/183 |
| 2017/0268811 | A1* | 9/2017 | Ochiai | F24F 11/36 |

* cited by examiner

HEAT PUMP SYSTEM WITH FAULT DETECTION

TECHNICAL FIELD

The present disclosure pertains to a Heating, Ventilation, and/or Air Conditioning (HVAC) system for a building. More particularly, the present disclosure pertains to fault detection in heat pump systems.

BACKGROUND

Heating, Ventilation, and/or Air Conditioning (HVAC) systems are often used to control the comfort level within a building or other structure. Such HVAC systems typically include an HVAC controller that controls various HVAC components of the HVAC system in order to affect and/or control one or more environmental conditions within the building. In many cases, the HVAC controller is disposed within the building and provides control signals to various HVAC components of the HVAC system. Improvements in the hardware, user experience, and functionality of such HVAC controllers, including remote sensor devices, would be desirable.

SUMMARY

The disclosure is directed to an HVAC system that includes fault detection. In a particular example of the disclosure, a system includes an indoor heat exchange coil and an outdoor heat exchange coil. The system includes an expansion valve and a compressor that compresses the refrigerant for delivery to one of the indoor heat exchange coil or the outdoor heat exchange coil, depending on whether there is a call for heat or a call for cooling within the building. The system may include a compressor discharge refrigerant temperature sensor that provides an indication of a temperature of the refrigerant exiting the compressor as well as an outdoor air temperature source for obtaining a measure of outdoor air temperature. A controller is operatively coupled to the compressor discharge refrigerant temperature sensor and the outdoor air temperature source and is configured to identify a difference between a temperature indicative of the temperature of the compressed refrigerant at or near the output of the compressor of the compressor and the measure of outdoor air temperature source. The controller is configured to identify a change in the identified difference over time and report a fault when the change in the difference exceeds a threshold.

In another example of the disclosure, a method is disclosed for detecting a fault in an HVAC system of a building in which the HVAC system includes a refrigerant loop with an indoor heat exchange coil, an outdoor heat exchange coil, an expansion valve and a compressor that compresses a refrigerant for delivery to one of the indoor heat exchange coil and the outdoor heat exchange coil. The method includes repeatedly sampling a temperature indicative of a temperature of the compressed refrigerant at or near an output of the compressor before the compressed refrigerant reaches any of the indoor heat exchange coil or the outdoor heat exchange coil, wherein each sample is taken with the temperature indicative of the temperature of the compressed refrigerant at or near an output of the compressor is stable. An outdoor air temperature is obtained. An average of a difference between each of the sampled temperatures indicative of the temperature of the compressed refrigerant at or near the output of the compressor and a corresponding outdoor air temperature is identified over a period of time. The method includes identifying a change in the identified average difference over time, and reporting a fault when the change in the average difference exceeds a threshold.

In another example of the disclosure, the server includes an input/output, a memory, and a processor that is operatively coupled to the input/output and to the memory. The processor is configured to store in the memory a plurality of temperatures each indicative of a temperature of a compressed refrigerant at or near an output of a compressor before the compressed refrigerant reaches any of an indoor heat exchange coil or an outdoor heat exchange coil of a remote HVAC system. The processor stores in the memory an outdoor air temperature that corresponds to each of the stored plurality of temperatures and identifies an average of a difference between each of the stored temperatures indicative of the temperature of the compressed refrigerant at or near the output of the compressor and the corresponding outdoor air temperature over a period of time. The processor identifies a change in the identified average difference over time, and outputs an alert via the input/output when the change in the average difference exceeds a threshold.

The above summary of some embodiments is not intended to describe each disclosed embodiment or every implementation of the present disclosure. The Figures, and Detailed Description, which follow, more particularly exemplify some of these embodiments.

BRIEF DESCRIPTION OF DRAWINGS

The disclosure may be more completely understood in consideration of the following description of various illustrative embodiments of the disclosure in connection with the accompanying drawings, in which.

Figure 1:
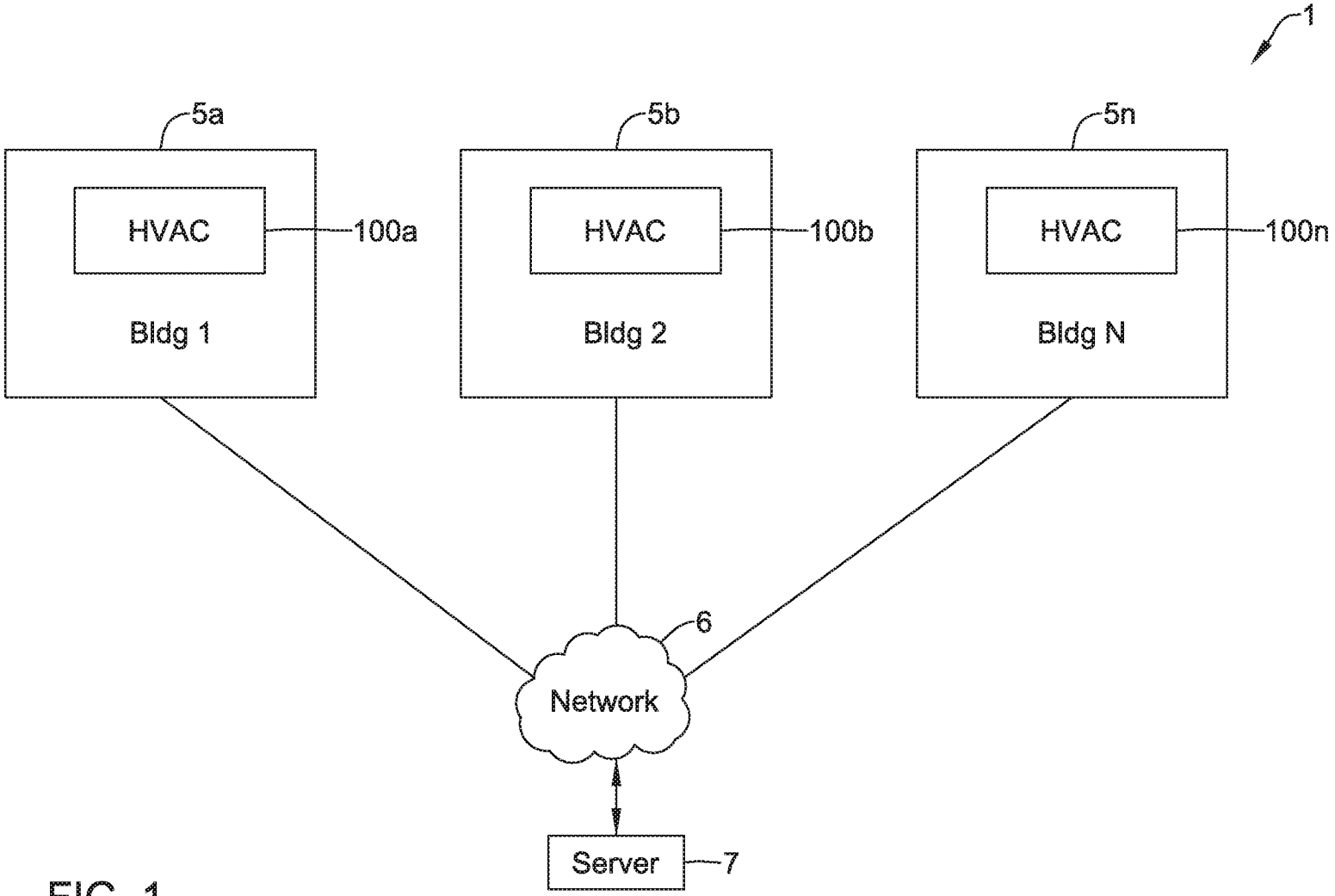
FIG. 1 is a schematic diagram of an illustrative HVAC monitoring system in which a plurality of HVAC systems operating in a plurality of buildings are monitored.

While the disclosure is amenable to various modifications and alternative forms, specifics thereof have been shown by way of example in the drawings and will be described in detail. It should be understood, however, that the intention is not to limit aspects of the disclosure to the particular illustrative embodiments described. On the contrary, the intention is to cover all modifications, equivalents, and alternatives falling within the spirit and scope of the disclosure.

DESCRIPTION

The following description should be read with reference to the drawings wherein like reference numerals indicate like elements. The drawings, which are not necessarily to scale, are not intended to limit the scope of the disclosure. In some of the figures, elements not believed necessary to an understanding of relationships among illustrated components may have been omitted for clarity.

All numbers are herein assumed to be modified by the term "about", unless the content clearly dictates otherwise. The recitation of numerical ranges by endpoints includes all numbers subsumed within that range (e.g., 1 to 5 includes 1, 1.5, 2, 2.75, 3, 3.80, 4, and 5).

As used in this specification and the appended claims, the singular forms "a", "an", and "the" include the plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is contemplated that the feature, structure, or characteristic may be applied to other embodiments whether or not explicitly described unless clearly stated to the contrary.

The present disclosure is directed generally at building automation systems. Building automation systems are systems that control one or more operations of a building. Building automation systems can include HVAC systems, security systems, fire suppression systems, energy management systems and other systems. While HVAC systems with HVAC controllers are used as an example below, it should be recognized that the concepts disclosed herein can be applied to building automation systems more generally. FIG. 1 shows a system 1 that includes a number of buildings including a BLDG 1 labeled as 5a, a BLDG 2 labeled as 5b through a BLDG N labeled as 5n. It will be appreciated that there may be any number of different buildings. At least some of the buildings 5a, 5b through 5n, collectively referred to as buildings 5, may represent individual residences such as homes, townhouses, condominiums, apartments, and the like. In some instances, at least some of the buildings 5 may be larger structures such as office buildings, retail buildings, and university buildings, for example.

Each of the buildings 5 has an HVAC system. For illustration purposes, the BLDG 1 that is labeled as 5a includes an HVAC system 100*a*, the BLDG 2 that is labeled as 5b includes an HVAC system 100*b*, and the BLDG N that is labeled as 5n includes an HVAC system 100*n*. It will be appreciated that some of the HVAC systems 100*a*, 100*b* through 100*n*, collectively referred to as HVAC systems 100, may include a variety of different heat, cooling and ventilation equipment. In some cases, at least some of the HVAC systems 100 may be forced air systems that utilize furnaces for heating and a separate air conditioning system for cooling. At least some of the HVAC systems 100 may be configured to utilize a heat pump system, in which the thermal properties of a refrigerant being expanded from a liquid to a gas, or being compressed from a gas to a liquid, are utilized in transferring heat between an environment outside of the building 100 and an interior of the building 100. When heating is called for, the refrigerant releases heat within an indoor air coil. Conversely, when cooling is called for, the refrigerant releases heat within an outdoor air coil (much like a traditional air conditioning unit).

In some cases, HVAC systems such as the HVAC systems 100 may be monitored. The HVAC systems 100 may be monitored and/or remotely controlled in order to improve energy efficiency, for example. The HVAC systems 100 may be adjusted from afar. For example, a homeowner may want to change a temperature set point for their residence, or they may wish to confirm that their system is running properly. In some cases, the HVAC systems 100 may be monitored in order to ensure that each of the HVAC systems 100 are running efficiently and are not showing any signs of a loss of efficiency. Accordingly, in some cases the system 1 includes a network 6 and a server 7, where the network 6 provides for communication between the server 7 and each of the HVAC systems 100. In some cases, the HVAC systems 100 may periodically provide data such as but not limited to temperature data to the server 7 via the network 6. In some cases, this temperature data may be useful in recognizing potential issues with the performance of one of the HVAC systems 100 early on, before equipment failure becomes an issue.

While the network 6 is schematically shown as a single element, it will be appreciated that the network 6 is intended to represent any number of distinct communication networks. For example, the network 6 may represent the Internet. The network 6 may be a local area network (LAN) or a wide area network (WAN). In some cases, the network 6 may represent a fiber optic network. The network 6 may provide a wireless access point and/or host a network host device that is part of the HVAC system 100.

Depending upon the application and/or where the HVAC user is located, remote access and/or control of the HVAC systems 100 may be provided over the network 6. A variety of mobile wireless devices may be used to access and/or control the HVAC systems 100 from a remote location over the network 6 including, but not limited to, mobile phones including smart phones, PDAs, tablet computers, laptop or personal computers, wireless network-enabled key fobs, e-Readers and the like.

In some cases, the HVAC system 100*s* may be programmed to communicate over the network 6 with an external web service hosted by the server 7. While schematically shown as a single element, the server 7 may instead include one or more external web servers. The server 7 may be considered as providing data collection and data analysis. A non-limiting example of an external web service is Honeywell's Light Commercial Building System (LCBS)™ web service. The HVAC systems 100 may be configured to upload selected data (e.g. fault detection) via the network 6 so that the data may be collected, stored and analyzed on the external web server 7. In some cases, the data may be indicative of the performance of the HVAC systems 100.

Figure 2:
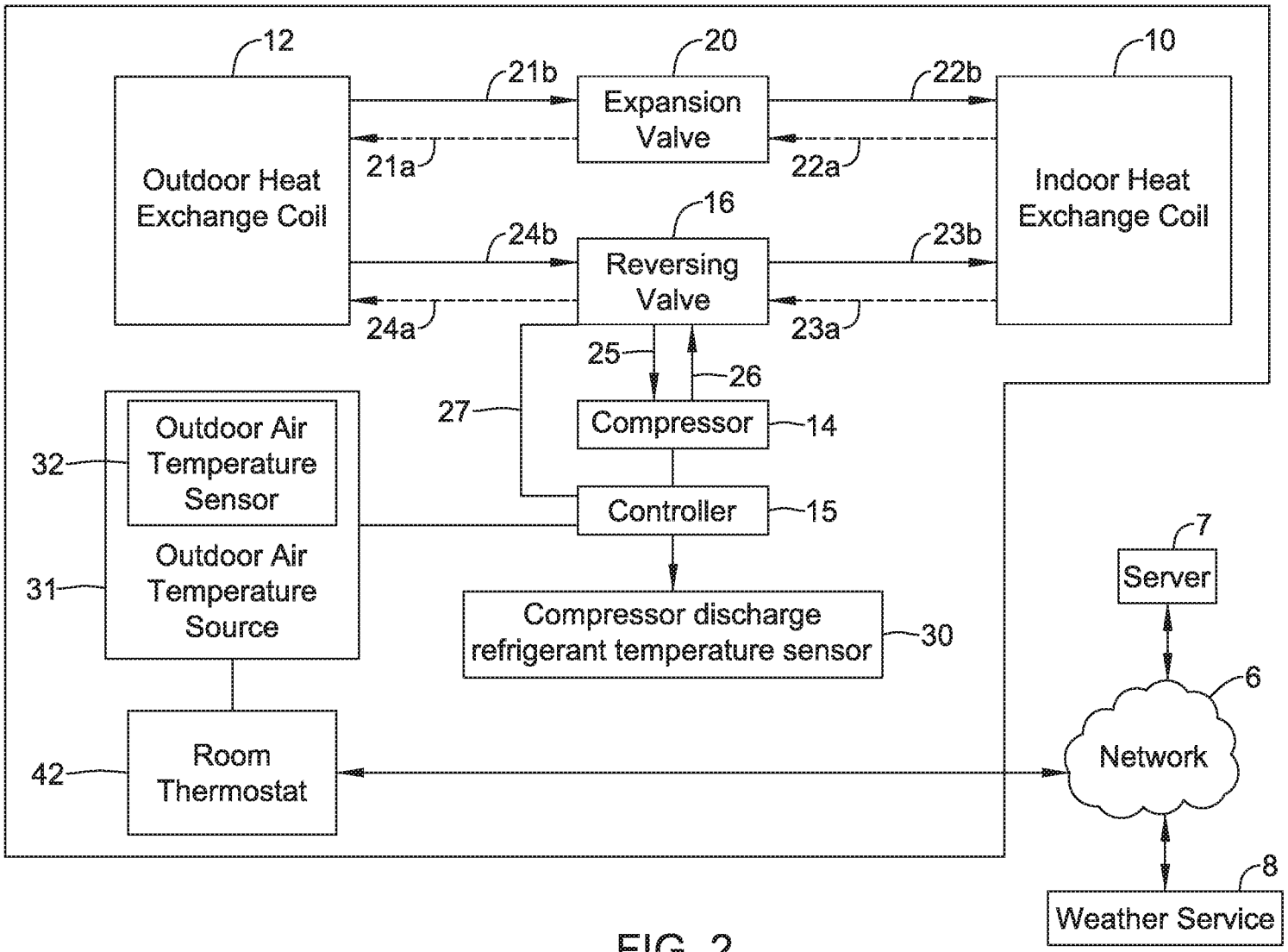
FIG. 2 is a schematic diagram of an illustrative HVAC control system.

FIG. 2 is a schematic diagram of one of the HVAC systems 100. The illustrated HVAC system 100 includes an indoor heat exchange coil 10, an outdoor heat exchange coil 12, and a compressor 14 that may compress the refrigerant for delivery to one of the indoor heat exchange coil 10 or the outdoor heat exchange coil 12. A reversing valve 16 is configured to direct the compressed refrigerant to the indoor heat exchange coil 10 when there is a call for heat and to direct the compressed refrigerant to the outdoor heat exchange coil 12 when there is a call for cooling. The compressed refrigerant will give off heat as it expands from a liquid to a gas while passing through either of the indoor heat exchange coil 10 or the outdoor heat exchange coil 12. A controller 15 is operatively coupled to the compressor 14 and is operably coupled to the reversing valve 16 via an electrical connection 27 so that the controller 15 can control operation of the reversing valve 16 in order to direct the compressed refrigerant in a desired direction. The HVAC system 100 includes an expansion valve 20 that is configured to allow for a pressure drop of the compressed refrigerant in order to allow the compressed refrigerant to expand from liquid to vapor within either the indoor heat exchange coil 10 or the outdoor heat exchange coil 12. The HVAC system 100 also includes refrigerant conduits that fluidly couple the components in the HVAC system 100. For example, a refrigerant conduit 21 fluidly couples the outdoor heat exchange coil 12 with the expansion valve 20. A refrigerant conduit 22 fluidly couples the expansion valve 20 with the indoor heat exchange coil 10. A refrigerant conduit 23 fluidly couples the indoor heat exchange coil 10 with the reversing valve 16. A refrigerant conduit 21 fluidly couples the outdoor heat exchange coil 12 with the reversing valve 16. A pair of refrigerant conduits 25 and 26 fluidly couple the compressor 14 with the reversing valve 16 such that fluid flow can continue in a loop, regardless of whether the compressed refrigerant is being directed to the indoor heat exchange coil 10 or the outdoor heat exchange coil 12.

As soon as the HVAC system 100 switches from a cooling mode to a heating mode, it now functions as a heat pump. The compressor 14 may deliver the compressed refrigerant to the outdoor heat exchange coil 12. The controller 15 may be used to switch the reversing valve 16 to change the direction of flow of the refrigerant there through via an electrical connection 27. The refrigerant may pass through the outdoor heat exchange coil 12 and through the expansion valve 20 via the refrigerant conduit 21 and through the indoor heat exchange coil 10 via the refrigerant conduit 22 and back to the input to the compressor 14 as indicated by the refrigerant conduit 25. The expansion valve 20 removes pressure from the liquid refrigerant to allow expansion or change of state from a liquid to a vapor in the outdoor heat exchange coil 12.

The reversing valve 16 may have a first position in which the compressor 14 delivers the compressed refrigerant to the outdoor heat exchange coil 12 via the refrigerant conduit 24. The refrigerant may pass through the outdoor heat exchange coil 12 through the refrigerant conduit 21 to the expansion valve 20 and through the refrigerant conduit 22 to the indoor heat exchange coil 10 and back through the refrigerant conduit 25 to the compressor 14. The reversing valve 16 may have a second position in which the compressor 14 may deliver the compressed refrigerant via the refrigerant conduit 26 to the indoor heat exchange coil 10 via the refrigerant conduit 23. The refrigerant may flow through indoor heat exchange coil 10 through the refrigerant conduit 22 to the expansion valve 20 through the refrigerant conduit 21 to the outdoor heat exchange coil 12 and back to an input to the compressor 14. This flow may be configured to provide a vapor compression system into which both cooling during warm ambient temperatures, indicated by solid arrows 21*b*-24*b*, and heating during cold ambient periods, indicated by dashed arrows 21-24*a*, is accomplished. Such a vapor compression system with a reversing valve 16 is commonly referred to as a heat pump.

If heating is being demanded, then the compressed hot refrigerant from the compressor 14 may be routed through the reversing valve 16 via the refrigerant conduit 26 toward the indoor heat exchange coil 10 via the refrigerant conduit 23 as shown in arrow 23*a* where its heat is given up to heat indoor air. When a heat pump is in heating mode, the pump is moving heat from outdoor air into an interior of the building 5 by moving outdoor air across the same outdoor heat exchange coil 12 that is now in heating mode. The compressed gas changes to a liquid in the indoor heat exchange coil 10, which is now acting as a condenser. As a result, the indoor heat exchange coil 10 gives off heat to the air flowing there across, as shown by arrows 22*a* and 21*a*. The flow of the liquid refrigerant from the indoor heat exchange coil 10 expands inside of outdoor heat exchange coil 12. The outdoor heat exchange coil 12 absorbs heat from the air flowing across there, therefore discharging cool air to the outside. The vapor in the outdoor heat exchange coil 12 flows via arrow 24*a* through the reversing valve 16 in to the compressor 14 as indicated by the refrigerant in conduit 25. The refrigerant is then compressed again by the compressor 14 and the cycle repeats.

Conversely, if cooling of the building 5 is desired, the controller 15 activates the compressor 14 and the high pressure hot refrigerant from the compressor 14 is routed through the refrigerant in conduit 26 to the reversing valve 16 to the outdoor heat exchange coil 12 in a direction indicated by the arrow 24*b* where the refrigerant is cooled for subsequent use indoors to cool the building 5. It may take some time after the compressor 14 is activated for the temperature of the compressed refrigerant at or near the output of the compressor 14 to reach a stable temperature. When the high liquid refrigerant is condensed to a liquid and subcools, it passes from the outdoor heat exchange coil 12 in a direction indicated by the arrows 21*b* and 22*b* to the indoor heat exchange coil 10. The cycle repeats as the refrigerant conduit 23. Through the reversing valve 16 and returns to the compressor 14 via the refrigerant conduit 25.

The controller 15 may be used to automatically change from heating to cooling, control and process algorithms, set a program schedule, provide remote access, diagnostics and protection, fault detection and protection, wired or wireless connection to a wall-mounted thermostat. A built-in fault detection system may be included to provide warnings and alerts to an end user and, if necessary, shut down the system. Remote access may also be provided through a remote control.

The controller 15 may be configured to identify the difference between the temperatures indicative of the temperature of the compressed refrigerant at or near the output of the compressor 14 and the measure of outdoor air temperature only after the compressed refrigerant at or near the output of the compressor 14 has reached a stable temperature. The compressed refrigerant at or near the output of the compressor 14 may reach a stable temperature when a rate of change of the temperature of the compressed refrigerant at or near the output of the compressor 14 may be below a rate threshold.

A compressor discharge refrigerant temperature sensor 30 may sense a temperature indicative of a temperature of the compressed refrigerant at or near an output of the compressor 14 before the compressed refrigerant reaches any of the indoor heat exchange coil 10 or the outdoor heat exchange coil 12. An outdoor air temperature sensor 32 may provide a measure of the outdoor air temperature. Measured temperatures may include outdoor air temperature, return air temperature, liquid line temperature, suction line temperature, fan motor temperature and such.

Software logic in the controller 15 may look at sensor data gathered by the communicating controls at periodic intervals to determine the moving average of the maximum difference between the compressor discharge refrigerant temperature as indicated by the compressor discharge refrigerant temperature sensor 30 and the outdoor air temperature as indicated by the outdoor air temperature sensor 32 when the compressor 14 is running and either comparing against a known good value determined during maintenance or looking for a change past a threshold over time. In some cases, the software logic that looks at the sensor data, and determines whether there has been an undesired change in the moving average of the maximum difference between the compressor discharge refrigerant temperature as indicated by the compressor discharge refrigerant temperature sensor 30 and the outdoor air temperature as indicated by the outdoor air temperature sensor 32 may instead reside within the server 7.

The controller 15 may further be configured to identify a moving average of the maximum difference between the temperature indicative of the temperature of the compressed refrigerant at or near the output of the compressor 14 as indicated by the compressor discharge refrigerant temperature sensor 30 and the measure of the outdoor air temperature as indicated by the outdoor air temperature 32. Over time the controller 15 may identify a change in the identified difference and report a fault when the change in the difference exceeds a threshold. The threshold may be a user-programmable threshold. In some cases, the threshold is programmed by the factory. In some instances, the threshold may indicate a temperature difference that is greater than 10 degrees F. The period of time may be at or around 10 minutes, as an example.

In some cases, an increase in the average maximum difference between the compressor discharge refrigerant temperature sensor 30 and the outdoor air temperature sensor 32 may mean that the compressor 14 is working harder than normal. Over time, this can result in a loss of energy efficiency as well as a possible reduction in the longevity of the equipment. This can also indicate that possible repairs or maintenance may be required. In addition, the average maximum difference between the compressor discharge refrigerant temperature sensor 30 and the outdoor air temperature sensor 32 may be normalized by adjusting for changes in outdoor wet bulb temperature which influences the efficiency of the condenser heat transfer and thus the compressor working temperature.

The HVAC system 100 may further include a room thermostat 42 which is configured to monitor and control a temperature within a space in which the room thermostat 42 is deployed. In some cases, the room thermostat 42 may be operably coupled to the outdoor air temperature source 31 as well as to the network 6. The room thermostat 42 may include a unique identifier, such as an electronic serial number, an IP address, and/or combinations thereof, which identifies the room thermostat 42 to the network 6. In some cases, the controller 15 may be implemented by the room thermostat 42 that is disposed within the building 5 and that is configured to thermostatically control the HVAC system 100 of the building 5. In some cases, the controller 15 may be implemented within the server 7.

Figure 3:
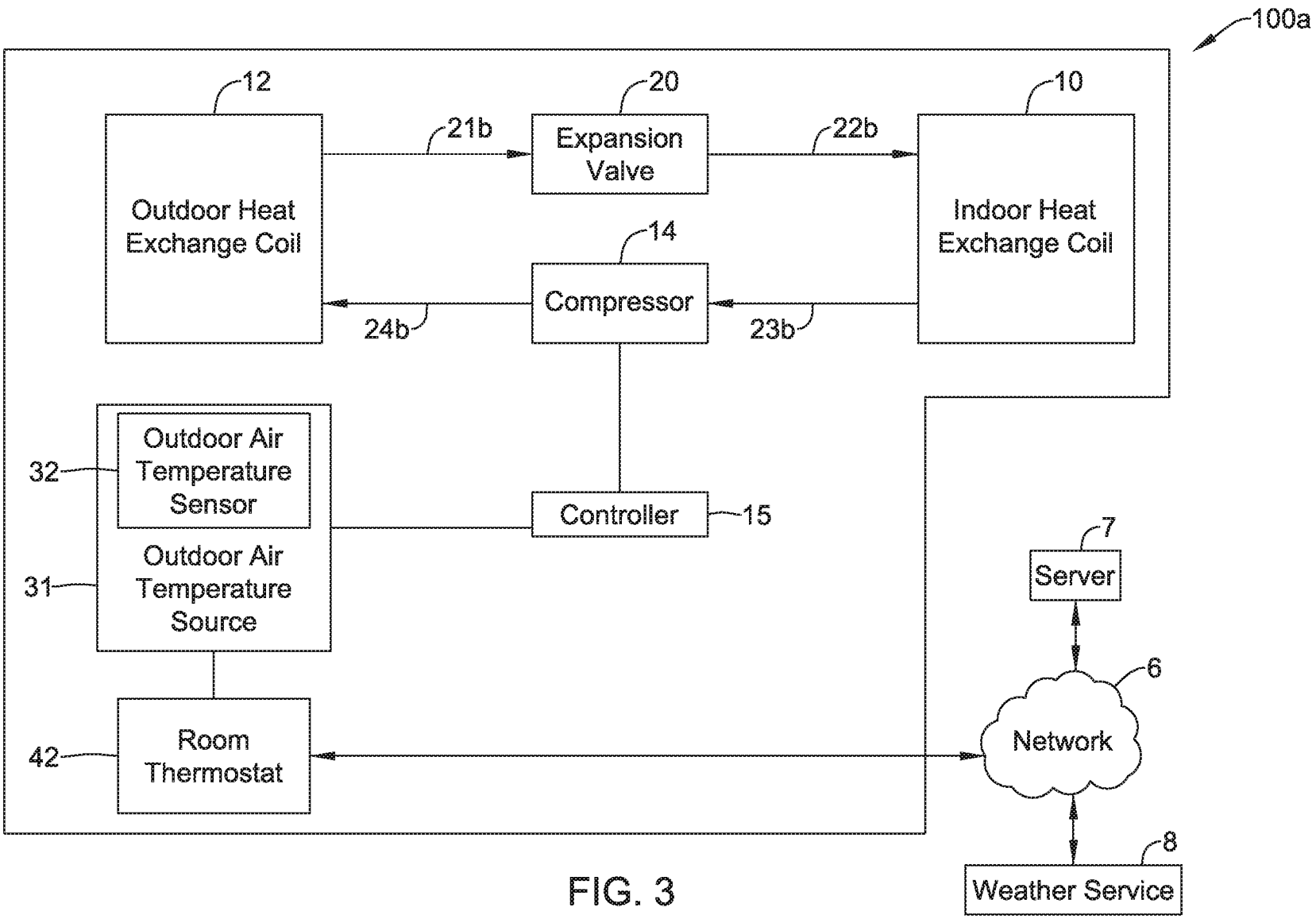
FIG. 3 is a schematic diagram of an illustrative HVAC control system.

The room thermostat 42 may be operably coupled with a weather service 8 may be operably coupled to the room thermostat 42 via the network 6. The weather service 8 may be configured to receive local weather data including outdoor temperature, outdoor humidity, a solar load, wind speed, weather alerts and/or warnings, as examples. The information provided by the weather service 8 come from the National Weather Service, for example, although this is not required FIG. 3 show a schematic diagram illustrative of an HVAC system 100*a* that lacks the reversing valve 16. In this configuration, the HVAC system 100*a* may operate as an air conditioning unit. For both a split air conditioning unit and a split heat pump there are two refrigerant lines connecting the units, one containing condensed liquid refrigerant and the other containing vapor refrigerant. When cooling of the building 5 is being demanded, the controller 15 activates the compressor 14. The high pressure hot refrigerant from the compressor 14 is routed through the refrigerant in the conduit 24 to the outdoor heat exchange coil 12 as indicated by the arrow 24*b* where the refrigerant gives up heat and is cooled for subsequent use indoors to cool the building 5. It may take some time after the compressor 14 is activated for the temperature of the compressed refrigerant at or near the output of the compressor 14 to reach a stable temperature.

Figure 4:
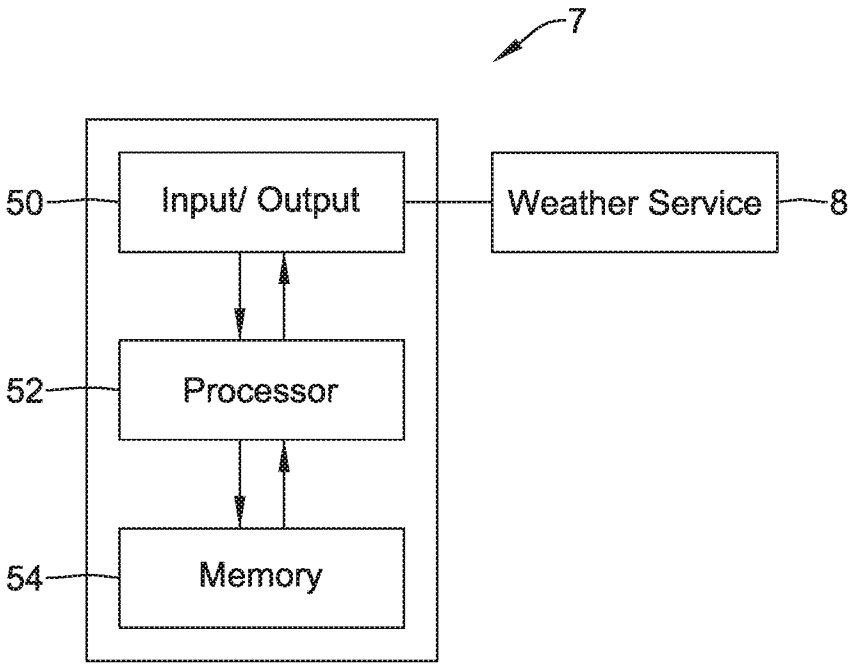
FIG. 4 is a schematic structural diagram of a server forming a portion of the embodying the present disclosure.

FIG. 4 is a schematic diagram of the server 7. The server 7 may include an input/output 50, a processor 52 and a memory 54. The memory 54 may store a plurality of outdoor air temperatures that are received via the input/output 50 from the building 5. The memory 54 may be used to store any desired information, such as algorithms, set points, schedule times, diagnostic limits, such as for example, differential pressure limits, delta T limits, and the like. The memory 54 may be any suitable storage device including, but not limited to RAM, ROM, EPROM, flash memory, a hard drive and/or the like. The input/output 50 may include a wireless transceiver for wirelessly sending and/or receiving signals over a wireless network 6. In some cases, the input/output 50 may be in communication with a wired or wireless router or gateway for connecting to the network 6, but this is not required.

In some cases the processor 54 may store information within the memory 52. The processor 54 may include a microprocessor, microcontroller, or such. The processor 52 may be operatively coupled to the input/output 50 and the memory 54. The processor 52 is configured to receive the input/output 50 and store in the memory 54 a plurality of temperatures each indicative of a temperature of a compressed refrigerant at or near an output of the compressor 14 before the compressed refrigerant reaches any of the indoor heat exchange coil 10 or the outdoor heat exchange coil 12. Each of the plurality of temperatures may be taken when the temperature indicative of the temperature of the compressed refrigerant at or near an output of the compressor 14 is stable. The processor 52 may identify an average of a difference between each of the stored temperatures indicative of the temperature of the compressed refrigerant at or near the output of the compressor 14 and the corresponding outdoor air temperature over a period of time. This time may be approximately 10 minutes. Further, processor 52 may identify a change in the identified average difference over time and output an alert via the input/output 50 when the change in the average difference exceeds a threshold. The alert may be provided to a contractor that is responsible for maintaining remote HVAC system 100. This alert may be configured to appear on a contractor's alert page display, dashboard, pad, tablet, smartphone, laptop or an office computer via a wire/and or wireless connection. The alert may be reporting of an event record. An event may pertain to a threshold of some kind that has been crossed. An alert may be either a sensed value going outside a specific bound or an analytic value exceeding a specified bound.

The outdoor air temperatures that correspond to each of the stored plurality of temperatures may be received from a remote weather service 8 via the input/output 50. The outdoor air temperature may be normalized by adjusting for changes an outdoor wet bulb temperature.

Figure 5:
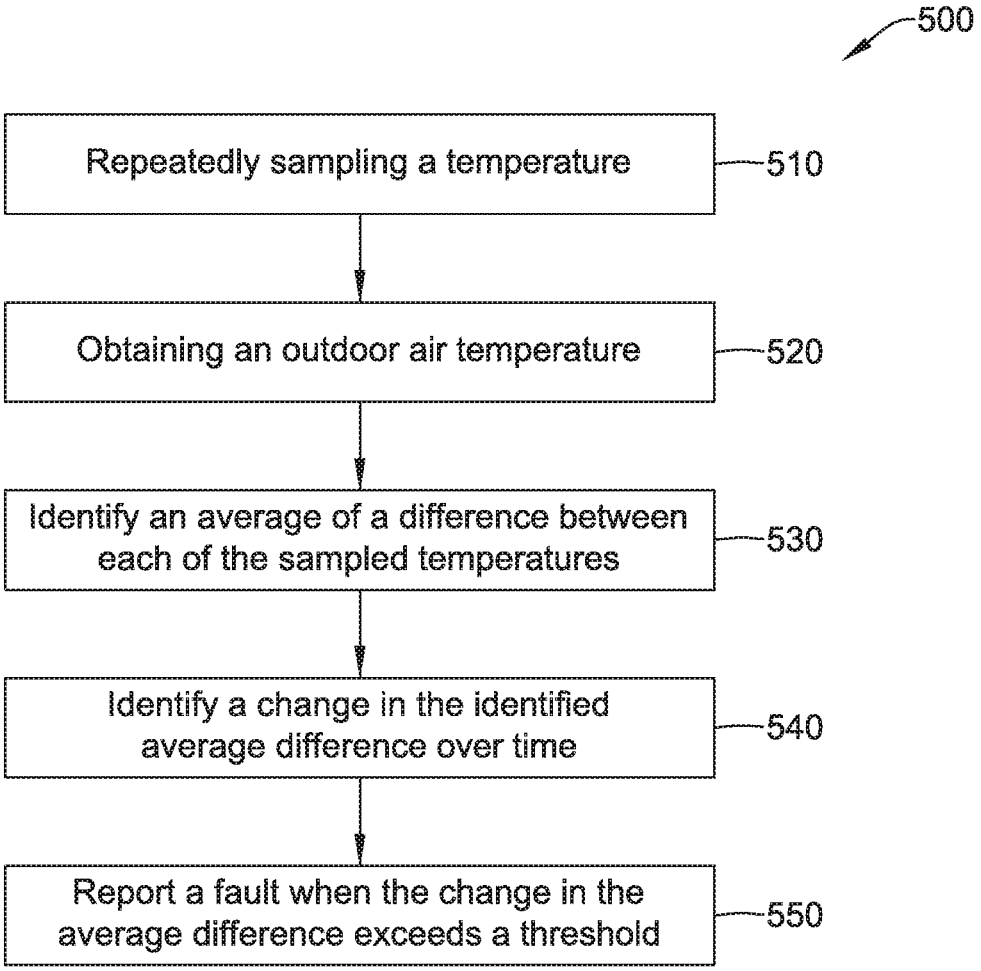
FIG. 5 is a flow diagram showing an illustrative fault detection method.

FIG. 5 is a flow diagram showing a method 500 for detecting a fault in an HVAC system such as but not limited to the HVAC system 100 described above. The method 500 may include repeatedly sampling a temperature indicative of the compressed refrigerant at or near an output of the compressor before the compressed refrigerant reaches either the indoor heat exchange coil 10 or the outdoor heat exchange coil 12 as indicated at block 510. In some cases, each sample may be taken when the temperature is indicative of the temperature of the compressed refrigerant at or near an output of the compressor is stable. The compressed refrigerant at or near the compressor 14 may be considered to be stable when a rate of change of the temperature of the compressed refrigerant at or near the output of the compressor 14 is below a rate threshold, for example.

An outdoor air temperature may be obtained from the outdoor air temperature sensor 32, as indicated at block 520. An average of a difference between each of the sampled temperatures indicative of the temperature of the compressed refrigerant at or near the output of the compressor and a corresponding outdoor air temperature over a period of time may be identified, as indicated at block 530. A change in the identified average difference may be identified over time, as indicated at block 540. A fault may be reported when the change in the average difference exceeds a threshold, as indicated at block 550.

Figure 6:
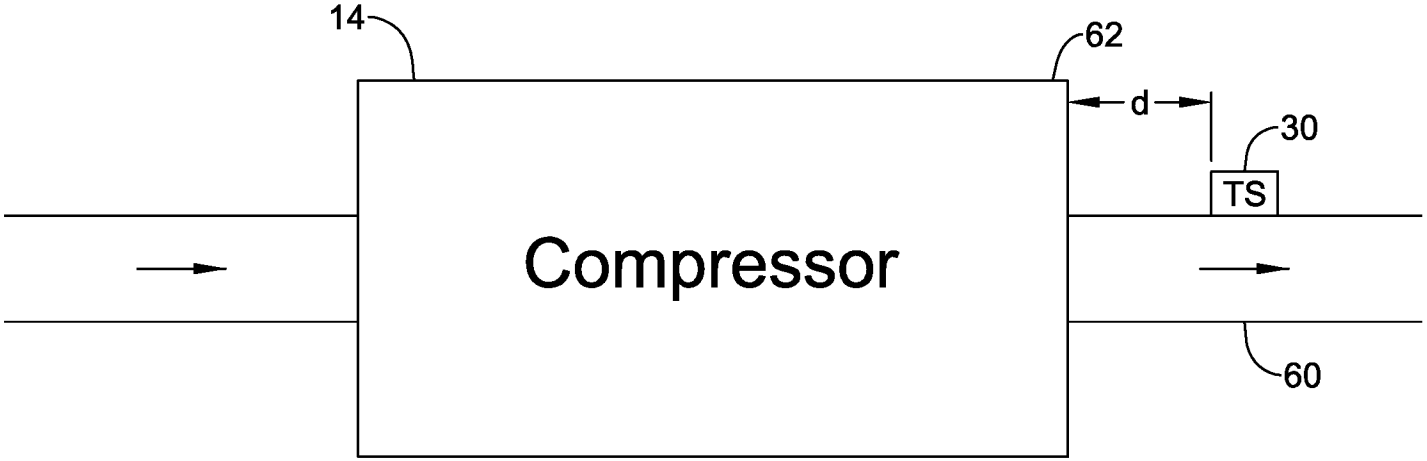
FIG. 6 shows a compressor with an output tube and a compressor discharge refrigerant temperature sensor thermally coupled to the output tube.

FIG. 6 shows the compressor 14 with an output tube 60 and the compressor discharge refrigerant temperature sensor 30 thermally coupled to the output tube 60. The compressor discharge refrigerant temperature sensor 30 may be thermally coupled to the output tube 60 within a distance "d" of four inches or less from an outer housing 62 of the compressor 14.

Those skilled in the art will recognize that the present disclosure may be manifested in a variety of forms other than the specific embodiments described and contemplated herein. Accordingly, the scope of legal protection given to this disclosure can only be determined by studying the following claims.

What is claimed is:

1. A system for transferring heat via a refrigerant between an indoor heat exchange coil and an outdoor heat exchange coil of an HVAC system of a building, the system including an expansion valve and a compressor that compresses the refrigerant for delivery to one of the indoor heat exchange coil or the outdoor heat exchange coil, the system comprising:

a compressor discharge refrigerant temperature sensor for sensing a temperature indicative of a temperature of the compressed refrigerant at or near an output of the compressor before the compressed refrigerant reaches any of the indoor heat exchange coil or the outdoor heat exchange coil;

an input port for receiving measure of outdoor air temperature;

a controller operatively coupled to the compressor discharge refrigerant temperature sensor and the input port, the controller configured to:

identify a difference between the temperature indicative of the temperature of the compressed refrigerant at or near the output of the compressor and the measure of the outdoor air temperature;

identify a change in the identified difference over time; and report a fault when the change in the difference exceeds a threshold.

2. The system of claim 1, wherein the compressor delivers the compressed refrigerant to the outdoor heat exchange coil, wherein the refrigerant passes through the outdoor heat exchange coil, through the expansion valve, through the indoor heat exchange coil and back to an input to the compressor.

3. The system of claim 1, wherein the compressor delivers the compressed refrigerant to the indoor heat exchange coil, wherein the refrigerant passes through the indoor heat exchange coil, through the expansion valve, through the outdoor heat exchange coil and back to an input to the compressor.

4. The system of claim 1, further comprising a reversing valve having a first position and a second position, wherein:

in the first position, the compressor delivers the compressed refrigerant to the outdoor heat exchange coil, wherein the refrigerant passes through the outdoor heat exchange coil, through the expansion valve, through the indoor heat exchange coil and back to an input to the compressor; and in the second position, the compressor delivers the compressed refrigerant to the indoor heat exchange coil, wherein the refrigerant passes through the indoor heat exchange coil, through the expansion valve, through the outdoor heat exchange coil and back to an input to the compressor.

5. The system of claim 1, wherein the controller is local to the building.

6. The system of claim 5, wherein the controller is implemented by a thermostat of the building that is configured to thermostatically control the HVAC system of the building.

7. The system of claim 1, wherein the controller is remote from the building.

8. The system of claim 7, wherein the controller is implemented by a server located remote from the building.

9. The system of claim 1, wherein the outdoor air temperature is received from an outdoor air temperature sensor that is operatively coupled to the input port via a wired or wireless connection.

10. The system of claim 1, wherein the outdoor air temperature is received from a weather service that is operably coupled to the input port.

11. The system of claim 1, wherein the output of the compressor comprises an output tube, and wherein the compressor discharge refrigerant temperature sensor is thermally coupled to the output tube.

12. The system of claim 11, wherein the compressor discharge refrigerant temperature sensor is thermally coupled to the output tube within four inches or less from an outer housing of the compressor.

13. The system of claim 1, wherein it takes some time after the compressor is activated for the temperature of the compressed refrigerant at or near the output of the compressor to reach a stable temperature, and wherein the controller is configured to identify the difference between the temperatures indicative of the temperature of the compressed refrigerant at or near the output of the compressor and the measure of outdoor air temperature only after the compressed refrigerant at or near the output of the compressor has reached a stable temperature.

14. The system of claim 13, wherein the compressed refrigerant at or near the output of the compressor has reached a stable temperature when a rate of change of the temperature of the compressed refrigerant at or near the output of the compressor is below a rate threshold.

15. The system of claim 1, wherein the controller is configured to:

identify an average difference between the temperature indicative of the temperature of the compressed refrigerant at or near the output of the compressor and the measure of outdoor air temperature over a period of time;

identify a change in the identified average difference over time; and report a fault when the change in the average difference exceeds a threshold.

16. A method for detecting a fault in an HVAC system of a building, wherein the HVAC system includes a refrigerant loop with an indoor heat exchange coil, an outdoor heat exchange coil, an expansion value and a compressor, wherein the compressor compresses a refrigerant for delivery to one of the indoor heat exchange coil and the outdoor heat exchange coil, the method comprising:

repeatedly sampling a temperature indicative of a temperature of the compressed refrigerant at or near an output of the compressor before the compressed refrigerant reaches any of the indoor heat exchange coil or the outdoor heat exchange coil, wherein each sample is taken when the temperature indicative of the temperature of the compressed refrigerant at or near an output of the compressor is stable;

obtaining an outdoor air temperature;

identifying an average of a difference between each of the sampled temperatures indicative of the temperature of the compressed refrigerant at or near the output of the compressor and a corresponding outdoor air temperature over a period of time;

identifying a change in the identified average difference over time; and reporting a fault when the change in the average difference exceeds a threshold.

17. The system of claim 16, wherein the compressed refrigerant at or near the output of the compressor is stable when a rate of change of the temperature of the compressed refrigerant at or near the output of the compressor is below a rate threshold.

18. A server comprising:

an input/output;

a memory;

a processor operatively coupled to the input/output and the memory, the processor configured to:

receive via the input/output and store in the memory a plurality of temperatures each indicative of a temperature of a compressed refrigerant at or near an output of a compressor before the compressed refrigerant reaches any of an indoor heat exchange coil or an outdoor heat exchange coil of a remote HVAC system, wherein each of the plurality of temperatures is taken when the temperature indicative of the temperature of the compressed refrigerant at or near an output of the compressor is stable;

store in the memory an outdoor air temperature that corresponds to each of the stored plurality of temperatures;

identify an average of a difference between each of the stored temperatures indicative of the temperature of the compressed refrigerant at or near the output of the compressor and the corresponding outdoor air temperature over a period of time;

identify a change in the identified average difference over time; and output an alert via the input/output when the change in the average difference exceeds a threshold.

19. The server of claim 18, wherein the outdoor air temperatures that correspond to each of the stored plurality of temperatures are received from a remote weather service via the input/output, and wherein the outdoor air temperature is normalized by adjusting for changes in an outdoor wet bulb temperature.

20. The server of claim 18, wherein the alert is provided to a contractor that is responsible for maintaining the remote HVAC system.

* * * * *